US007313517B2

(12) United States Patent
Beerends et al.

(10) Patent No.: US 7,313,517 B2
(45) Date of Patent: Dec. 25, 2007

(54) METHOD AND SYSTEM FOR SPEECH QUALITY PREDICTION OF AN AUDIO TRANSMISSION SYSTEM

(75) Inventors: John Gerard Beerends, Hengstdijk (NL); Marc Jan Christiaan Van Den Homberg, The Hague (NL)

(73) Assignee: Koninklijke KPN N.V., Groningen (NL)

( * ) Notice: Subject to any disclaimer, the term of this patent is extended or adjusted under 35 U.S.C. 154(b) by 0 days.

(21) Appl. No.: 10/549,003

(22) PCT Filed: Feb. 26, 2004

(86) PCT No.: PCT/EP2004/002026

§ 371 (c)(1),
(2), (4) Date: Sep. 14, 2005

(87) PCT Pub. No.: WO2004/088638

PCT Pub. Date: Oct. 14, 2004

(65) Prior Publication Data

US 2006/0171543 A1 Aug. 3, 2006

(30) Foreign Application Priority Data

Mar. 31, 2003 (EP) ..... 03075949

(51) Int. Cl.
*G10L 19/00* (2006.01)

(52) U.S. Cl. ..... 704/200; 379/1.03

(58) Field of Classification Search ..... 379/1.03; 704/200

See application file for complete search history.

(56) References Cited

U.S. PATENT DOCUMENTS 3,970,926 A * 7/1976 Rigby et al. ..... 324/621
4,862,492 A * 8/1989 Zwick ..... 379/22.02

OTHER PUBLICATIONS

J.G. Beerends et al, "Perceptual Evaluation of Speech Quality (PESQ), the new ITU standard for end-to-end speech quality assessment. Part II—Psychoacoustic model", For Publication in J. Audio Eng. Soc.), Jun. 2001, pp. 1-27.
(International Search Report).

* cited by examiner

*Primary Examiner*—Daniel Abebe
(74) *Attorney, Agent, or Firm*—Michaelson & Associates; Peter L. Michaelson

(57) ABSTRACT

Method and system for measuring the transmission quality of an audio transmission system (10). Preprocessing means (12) are present for preprocessing of an input signal (X) and an output signal (Y) to obtain pitch power densities (PPX-wIKss(j)" 1'PYwrR.ss(fin) for the respective signals. Compensation means (13, 14) are provided for compensation of linear frequency response and time varying gain. Calculation means (13, 14) are present for calculation of loudness densities (LX(I)n, LY(fi,) from the compensated pitch power densities, and computation means (15, 16) are provided for computation of a score (Q) indicative of the transmission quality of the system (10) from the loudness densities. The compensation means (13, 14) comprise an iterative loop having at least three calculations of compensations, each calculation comprising one of a calculation of a compensation of linear frequency response and a calculation of a local power scaling factor.

15 Claims, 3 Drawing Sheets

METHOD AND SYSTEM FOR SPEECH QUALITY PREDICTION OF AN AUDIO TRANSMISSION SYSTEM

FIELD OF THE INVENTION

The present invention relates to a method and a system for measuring the transmission quality of a system under test, an input signal entered into the system under test and an output signal resulting from the system under test being processed and mutually compared.

PRIOR ART

Such a method and system are known from ITU-T recommendation P.862, "Telephone transmission quality, telephone installations, local line networks—Methods for objective and subjective assessment of quality—Perceptual evaluation of speech quality (PESQ), an objective method for end-to-end speech quality assessment of narrow-bank telephone networks and speech codecs", ITU-T 02.2001 [8].

Also, the article by J. Beerends et al. "Perceptual Evaluation of Speech Quality (PESQ) The New ITU Standard for end-to-end Speech Quality Assessment Part II—Psychoacoustic Model", J. Audio Eng. Soc., Vol. 50, no. 10, October 2002, describes such a method and system [9].

A disadvantage is present in the P.862 method and system, as the method and system applied in the standard quality measurement does not correctly compensate for large variations in frequency response of the system under test and for large differences in local power between input and output signal. This may result in a bad correlation between the scores of perceived quality of speech as provided by the method and system and the perceived quality of speech as evaluated by test persons.

SUMMARY OF THE INVENTION

The present invention seeks to provide an improvement of the correlation between the perceived quality of speech as measured by the P.862 method and system and the actual quality of speech as perceived by test persons.

According to the present invention, a method according to the preamble defined above is provided, in which the compensation of linear frequency response and time varying gain comprises an iterative loop having at least three calculations of compensations, each calculation comprising one of a calculation of a compensation of linear frequency response and a calculation of a local power scaling factor.

The present invention is based on the understanding that in certain circumstances (presence of noise, presence of large frequency response deviations in system under test) the existing standardized method does not correctly measure the perceived quality of speech.

If a frequency compensation is calculated in the presence of noise a wrong estimate of the frequency response function will arise in frequency regions where there is little energy. If a local temporal scaling factor is calculated on a signal that has passed through a system which shows large deviations in the frequency response the local scaling factor cannot be calculated correctly. Both effects have to be calculated correctly in order to be able to predict the subjectively perceived quality of speech signals.

A correction may be implemented according to the present invention by replacing the calculation of a linear frequency compensation and the calculation of a local power scaling factor by an iterative calculation of the frequency compensation and local scaling factor. By first calculating a rough estimate of the necessary frequency compensation, i.e. by not compensating to the amount that one would normally carry out, one obtains a signal in time from which better estimations can be made regarding the local temporal scaling factor that is necessary for correctly predicting the final perceived quality. After this local scaling calculation one obtains a time signal from which a better estimation can be made for the necessary frequency compensation.

Overall, this will improve the performance of the speech quality prediction using the method according to the invention. Also, in other circumstances, this adaptation of the standardized method and system will not have a negative influence in other circumstances.

The calculation of the local power scaling factor may be implemented as described in the ITU-T Recommendation P.862, or alternatively as described in the non-prepublished applicant's European patent application 02075973 [10], which is included herein by reference.

In a particular advantageous embodiment, the iterative loop comprises a calculation of a first partial linear frequency compensation and application of the first partial linear frequency compensation to the pitch power density of the input signal, followed by a calculation of a local power scaling factor and application of the local power scaling factor to the pitch power density of the output signal, followed by a calculation of a second partial linear frequency compensation and application of the linear frequency compensation to the partially compensated pitch power density of the input signal. In a further embodiment, the application of the compensations to the pitch power densities of the input and output signal are interchanged, i.e., the first and second partial linear frequency compensations are applied to the pitch power density of the output signal, and the local power scaling factor is applied to the pitch power density of the input signal. These embodiments require only very little changes to the existing standardized P.862 method, while improving its performance.

In a further embodiment, the partial linear frequency compensation is a first estimate which is lower than the linear frequency compensation one would use for correct evaluation of the linear distortion (as prescribed in e.g. the ITU-T Recommendation P.862), e.g. 50% of the amplitude correction of the normal linear frequency compensation. This partial compensation can also be carried out frequency dependent, e.g. by having limited frequency ranges over which a larger partial compensation is carried out than over other frequency ranges. One can e.g. only compensate frequency response compensations as found with close microphone techniques that result in a low frequency boost below about 500 Hz.

In a second aspect, the present invention relates to a system for measuring the transmission quality of an audio transmission system as defined in the preamble above, in which the compensation means comprise an iterative loop having at least three calculations of a compensation, each calculation comprising one of a calculation of a compensation of linear frequency response and a calculation of a local power scaling factor. This system, and the systems as defined in the dependent claims, provides advantages comparable to the advantages of the method as described above.

SHORT DESCRIPTION OF DRAWINGS

The present invention will be discussed in more detail below, using a number of exemplary embodiments, with reference to the attached drawings, in which FIG. 1 shows schematically a prior-art PESQ system, disclosed in ITU-T recommendation P.862.

DETAILED DESCRIPTION OF EXEMPLARY EMBODIMENTS

Figure 1:
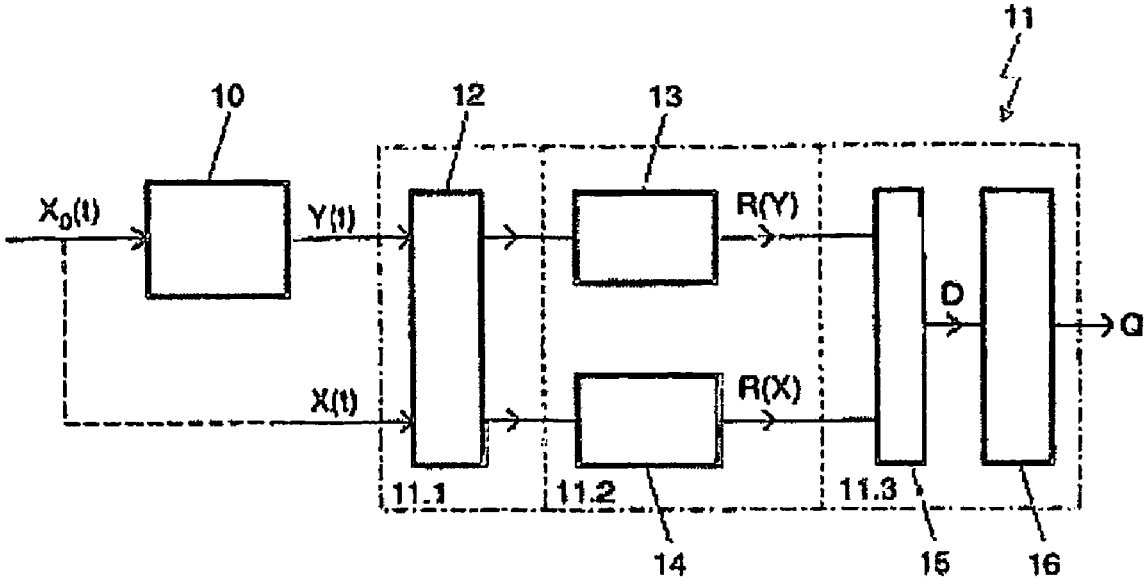

FIG. 1 shows schematically a known set-up of an application of an objective measurement technique which is based on a model of human auditory perception and cognition, and which follows the ITU-T Recommendation P.862 [8], for estimating the perceptual quality of speech links or codecs. The acronym used for this technique or device is PESQ (Perceptual Evaluation of Speech Quality). It comprises a system or telecommunications network under test 10, hereinafter referred to as system 10 for briefness' sake, and a quality measurement device 11 for the perceptual analysis of speech signals offered. A speech signal $X_0(t)$ is used, on the one hand, as an input signal of the system 10 and, on the other hand, as a first input signal X(t) of the device 11. An output signal Y(t) of the system 10, which in fact is the speech signal $X_0(t)$ affected by the system 10, is used as a second input signal of the device 11. An output signal Q of the device 11 represents an estimate of the perceptual quality of the speech link through the system 10. Since the input end and the output end of a speech link, particularly in the event it runs through a telecommunications network, are remote, for the input signals of the quality measurement device 11 use is made in most cases of speech signals X(t) stored on data bases. Here, as is customary, speech signal is understood to mean each sound basically perceptible to the human hearing, such as speech and tones. The system under test 10 may of course also be a simulation system, which simulates a telecommunications network. The device 11 carries out a main processing step which comprises successively, in a pre-processing section 11.1, a step of pre-processing carried out by pre-processing means 12, in a processing section 11.2, a further processing step carried by first and second signal processing means 13 and 14, and, in a signal combining section 11.3, a combined signal processing step carried out by signal differentiating means 15 and modelling means 16. In the pre-processing step the signals X(t) and Y(t) are prepared for the step of further processing in the means 13 and 14, the pre-processing including power level scaling and time alignment operations. The further processing step implies mapping of the (degraded) output signal Y(t) and the reference signal X(t) on representation signals R(Y) and R(X) according to a psycho-physical perception model of the human auditory system. During the combined signal processing step a differential or disturbance signal D is determined by the differentiating means 15 from said representation signals, which is then processed by modelling means 16 in accordance with a cognitive model, in which certain properties of human testees have been modelled, in order to obtain the quality signal Q.

In a first step executed by the PESQ system a series of delays between original input and degraded output are computed, one for each time interval for which the delay is significantly different from the previous time interval. For each of these intervals a corresponding start and stop point is calculated. The alignment algorithm is based on the principle of comparing the confidence of having two delays in a certain time interval with the confidence of having a single delay for that interval. The algorithm can handle delay changes both during silences and during active speech parts.

Based on the set of delays that are found, the PESQ system compares the original (input) signal with the aligned degraded output of the device under test using a perceptual model. The key to this process is transformation of both the original and the degraded signals to internal representations (LX, LY), analogous to the psychophysical representation of audio signals in the human auditory system, taking account of perceptual frequency (Bark) and loudness (Sone). This is achieved in several stages: time alignment, level alignment to a calibrated listening level, time-frequency mapping, frequency warping, and compressive loudness scaling.

The internal representation is processed to take account of effects such as local gain variations and linear filtering that may—if they are not too severe—have little perceptual significance. This is achieved by limiting the amount of compensation and making the compensation lag behind the effect. Thus minor, steady-state differences between original and degraded are compensated. More severe effects, or rapid variations, are only partially compensated so that a residual effect remains and contributes to the overall perceptual disturbance. This allows a small number of quality indicators to be used to model all subjective effects. In the PESQ system, two error parameters are computed in the cognitive model; these are combined to give an objective listening quality MOS (Mean Opinion Score). The basic ideas used in the PESQ system are described in the bibliography references [1] to [5].

The Perceptual Model in the Prior-Art PESO System

Figure 2:
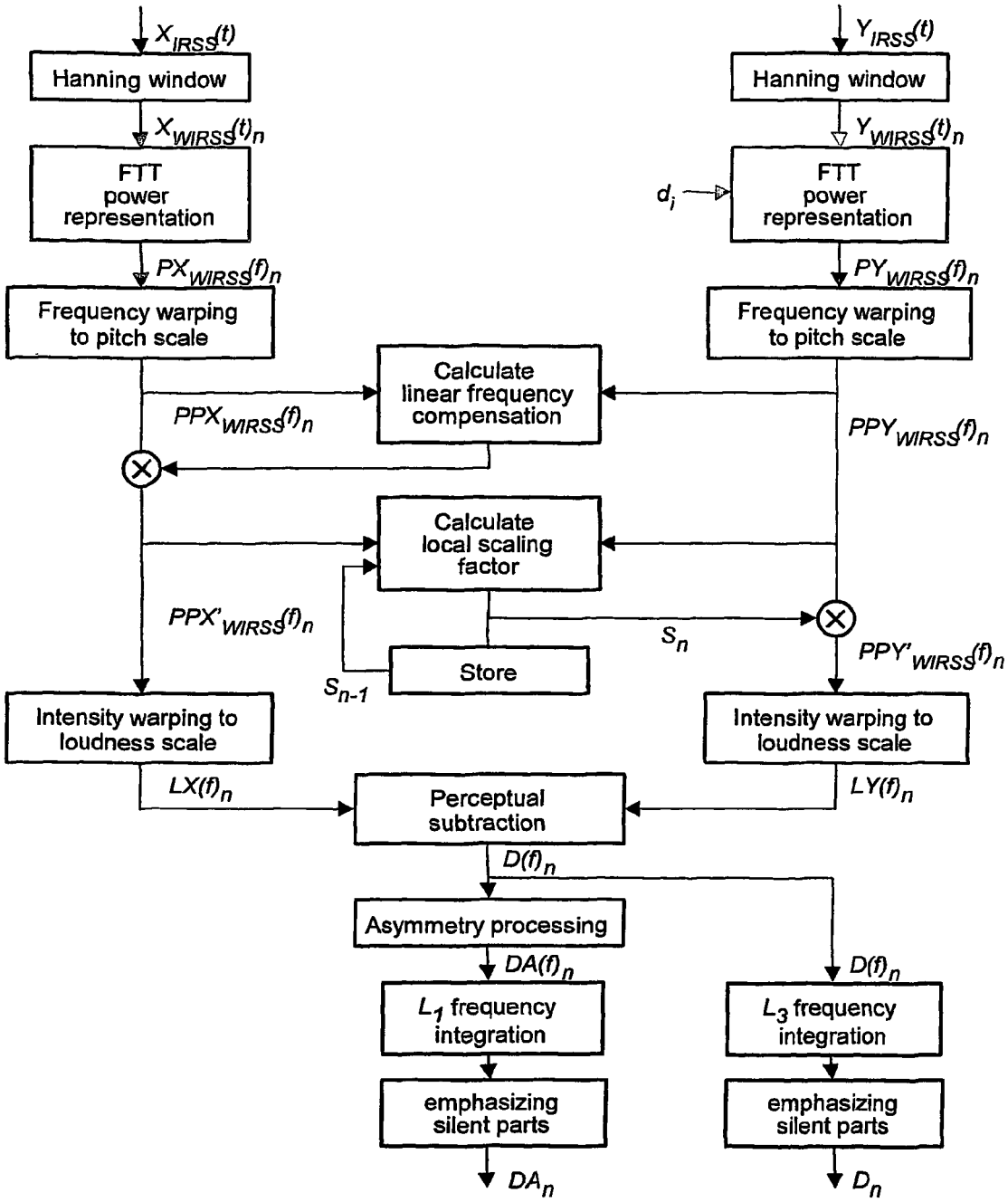
FIG. 2 shows a view of a perceptual model implementation as used in the PESQ system of FIG. 1.

In FIG. 2, a part of an implementation of the device 11 (i.e. the perceptual model part) is illustrated, comprising in essence the first and second signal processing means 13 and 14, and the differentiating means 15 as described above.

The perceptual model of a PESQ system, shown in FIG. 2, is used to calculate a distance between the original and degraded speech signal ("PESQ score"). This may be passed through a monotonic function to obtain a prediction of a subjective MOS for a given subjective test. The PESQ score is mapped to a MOS-like scale.

Absolute Hearing Threshold

The absolute hearing threshold $P_0(f)$ is interpolated to get the values at the center of the Bark bands that are used. These values are stored in an array and are used in Zwicker's loudness formula.

The Power and Loudness Scaling Factors

There are arbitrary gain constants following the FFT for time-frequency analysis and in the loudness calculation only meant for calibrating the system

IRS-Receive Filtering

If it is assumed that the listening tests were carried out using an IRS (intermediate reference system) receive or a modified IRS receive characteristic in the handset the necessary filtering to the speech signals is applied in the pre-processing (section 11.1 in FIG. 1), resulting in signals $X_{IRSS}(t)$ and $Y_{IRSS}(t)$.

Computation of the Active Speech Time Interval

If the original and degraded speech file start or end with large silent intervals, this could influence the computation of certain average distortion values over the files. Therefore, an estimate is made of the silent parts at the beginning and end of these files.

Short Term FFT or Time-Frequency Decomposition

The human ear performs a time-frequency transformation. In the PESQ system this is implemented by a short term FFT with overlap between successive time windows (frames). The power spectra—the sum of the squared real and squared imaginary parts of the complex FFT components—are stored in separate real valued arrays for the original and degraded signals. Phase information within a single Hanning window is discarded in the PESQ system and all calculations are based on only the power representations $PX_{WIRSS}(f)_n$ and $PY_{WIRSS}(f)^n$. The start points of the windows in the degraded signal are shifted over the delay. The time axis of the original speech signal is left as is. If the delay increases, parts of the degraded signal are omitted from the processing, while for decreases in the delay parts are repeated.

Calculation of the Pitch Power Densities

The Bark scale reflects that at low frequencies, the human hearing system has a finer frequency resolution than at high frequencies. This is implemented by binning FFT bands and summing the corresponding powers of the FFT bands with a normalization of the summed parts. The warping function that maps the frequency scale in Hertz to the pitch scale in Bark does not exactly follow the values given in the literature. The resulting signals are known as the pitch power densities $PPX_{WIRSS}(f)_n$, and $PPY_{WIRSS}(f)_n$.

Compensation of the Original Pitch Power Density (linear Frequency Response Compensation)

To deal with filtering in the system under test, the power spectrum of the original and degraded, pitch power densities are averaged over time. This average is calculated over speech active frames only using time-frequency cells whose power is a certain fraction above the absolute hearing threshold. Per modified Bark bin, a partial compensation factor is calculated from the ratio of the degraded spectrum to the original spectrum. The original pitch power density $PPX_{WIRSS}(f)_n$ of each frame n is then multiplied with this partial compensation factor to equalize the original to the degraded signal. This results in an inversely filtered original pitch power density $PPX'_{WIRSS}(f)_n$. This partial compensation is used because severe filtering can be disturbing to the listener. The compensation is carried out on the original signal because the degraded signal is the one that is judged by the subjects in an ACR experiment.

Compensation of the Distorted Pitch Power Density (Time-Varying Gain Compensation)

Short-term gain variations are partially compensated by processing the pitch power densities frame by frame (i.e. local compensation). For the original and the degraded pitch power densities, the sum in each frame n of all values that exceed the absolute hearing threshold is computed. The ratio of the power in the original and the degraded files is calculated and bounded to a predetermined range. A first order low pass filter (along the time axis) is applied to this ratio. The distorted pitch power density in each frame, n, is then multiplied by this ratio, resulting in the partially gain compensated distorted pitch power density $PPY'_{WIRSS}(f)_n$.

Figure 3:
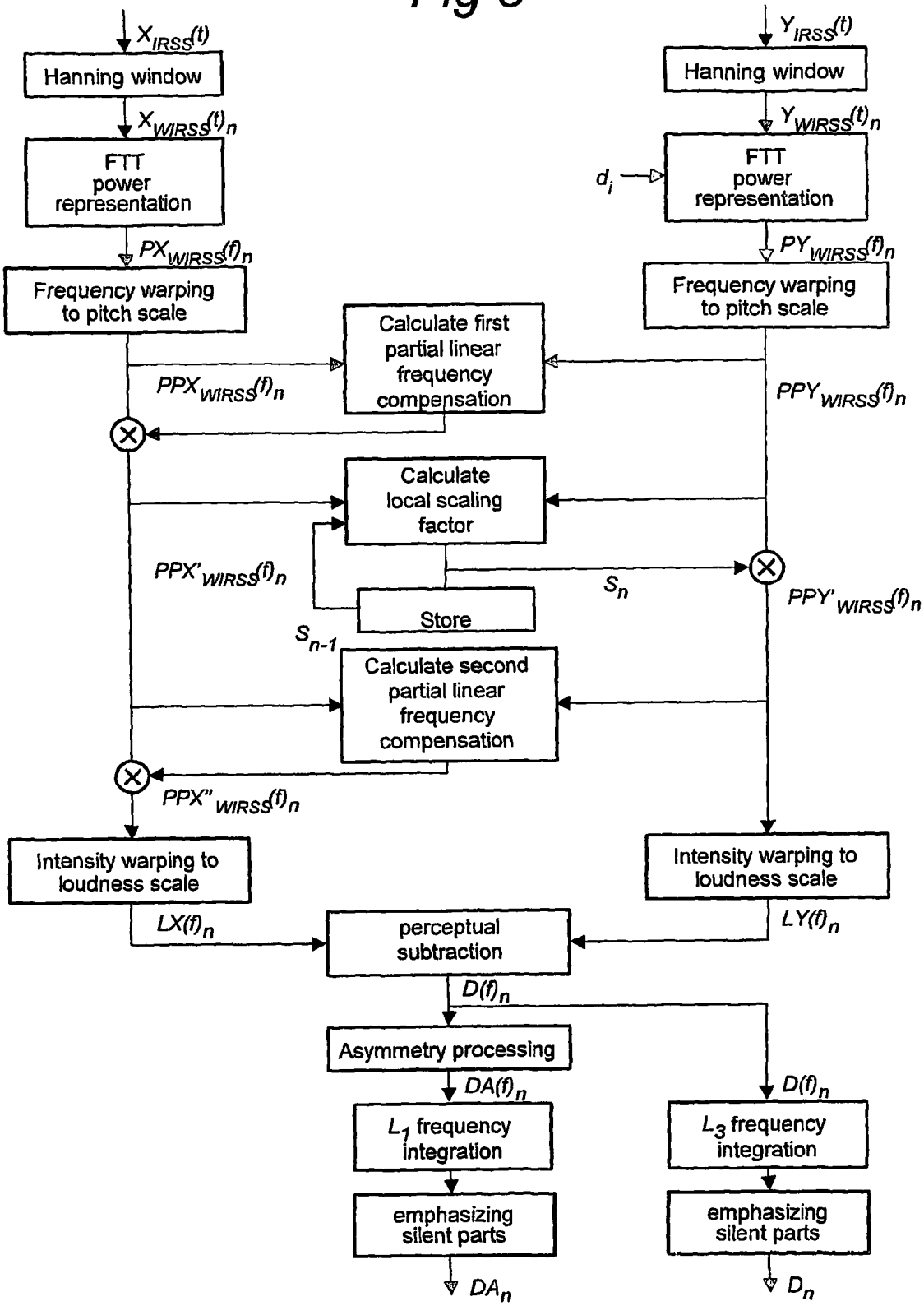
FIG. 3 shows the same PESQ implementation as FIG. 2 which, however, is modified to be fit for executing the method according to an embodiment of the present invention.

This partial compensation or calculation of local scaling factor may be implemented using the embodiment described in the applicant's pending, non-prepublished European patent application 02075973.4, which is incorporated herein by reference (see specifically FIG. 3).

Calculation of the Loudness Densities

After compensation for filtering and short-term gain variations, the original and degraded pitch power densities are transformed to a Sone loudness scale using Zwicker's law [7].

$$LX(f)_n = S_l \cdot \left(\frac{P_0(f)}{0.5}\right)^{\gamma} \cdot \left[\left(0.5 + 0.5 \cdot \frac{PPX'_{WIRSS}(f)_n}{P_0(f)}\right)^{\gamma} - 1\right]$$

with $P_0(f)$ the absolute threshold and $S_1$ the loudness scaling factor.

Above 4 Bark, the Zwicker power, $\gamma$, is 0.23, the value given in the literature. Below 4 Bark, the Zwicker power is increased slightly to account for the so-called recruitment effect. The resulting two-dimensional arrays $LX(f)_n$ and $LY(f)_n$ are called loudness densities.

Calculation of the Disturbance Density

The signed difference between the distorted and original loudness density is computed. When this difference is positive, components such as noise have been added. When this difference is negative, components have been omitted from the original signal. This difference array is called the raw disturbance density.

The minimum of the original and degraded loudness density is computed for each time frequency cell. These minima are multiplied by 0.25. The corresponding two-dimensional array is called the mask array. The following rules are applied in each time-frequency cell:

- If the raw disturbance density is positive and larger than the mask value, the mask value is subtracted from the raw disturbance.
- If the raw disturbance density lies in between plus and minus the magnitude of the mask value the disturbance density is set to zero.
- If the raw disturbance density is more negative than minus the mask value, the mask value is added to the raw disturbance density.

The net effect is that the raw disturbance densities are pulled towards zero. This represents a dead zone before an actual time frequency cell is perceived as distorted. This models the process of small differences being inaudible in the presence of loud signals (masking) in each time-frequency cell. The result is a disturbance density as a function of time (window number $\eta$) and frequency, $D(f)_n$.

This perceptual subtraction of the loudness densities $LX(f)_n$ and $LY(f)_n$, resulting in the disturbance density $D(f)_n$, may be implemented as described with reference to FIG. 4 of the applicant's pending, non-prepublished European patent application 02075973.4, which is incorporated herein by reference.

Cell-Wise Multiplication with an Asymmetry Factor

The asymmetry effect is caused by the fact that when a codec distorts the input signal it will in general be very difficult to introduce a new time-frequency component that integrates with the input signal, and the resulting output signal will thus be decomposed into two different percepts, the input signal and the distortion, leading to clearly audible distortion [2]. When the codec leaves out a time-frequency component the resulting output signal cannot be decomposed in the same way and the distortion is less objectionable. This effect is modelled by calculating an asymmetrical disturbance density $DA(f)_n$ per frame by multiplication of the disturbance density $D(f)_n$ with an asymmetry factor. This asymmetry factor equals the ratio of the distorted and original pitch power densities raised to the power of 1.2. If the asymmetry factor is less than 3 it is set to zero. If it exceeds 12 it is clipped at that value. Thus only those time frequency cells remain, as non-zero values, for which the degraded pitch power density exceeded the original pitch power density.

Aggregation of the Disturbance Densities

The disturbance density $D(f)_n$ and asymmetrical disturbance density $DA(f)_n$ are integrated (summed) along the frequency axis using two different Lp norms and a weighting on soft frames having low loudness):

$$D_n = M_n \sqrt[3]{\sum_{f=1,\ldots Numberof\ Barkbands} (|D(f)_n|\ W_f)^3}$$

$$DA_n = M_n \sum_{f=1,\ldots Numberof\ Barkbands} (|DA(f)_n| W_f)$$

with $M_n$ a multiplication factor, 1/(power of original frame plus a constant)$^{0.04}$, resulting in an emphasis of the disturbances that occur during silences in the original speech fragment, and $W_f$ a series of constants proportional to the width of the modified Bark bins. After this multiplication the frame disturbance values are limited to a maximum of 45. These aggregated values, $D_n$ and $DA_n$, are called frame disturbances.

If the distorted signal contains a decrease in the delay larger than 16 ms (half a window) the repeat strategy is modified. It was found to be better to ignore the frame disturbances during such events in the computation of the objective speech quality. As a consequence frame disturbances are zeroed when this occurs. The resulting frame disturbances are called $D'_n$ and $DA'_n$.

Realignment of Bad Intervals

Consecutive frames with a frame disturbance above a threshold are called bad intervals. In a minority of cases the objective measure predicts large distortions over a minimum number of bad frames due to incorrect time delays observed by the preprocessing. For those so-called, bad intervals a new delay value is estimated by maximizing the cross correlation between the absolute original signal and absolute degraded signal adjusted according to the delays observed by the preprocessing. When the maximal cross correlation is below a threshold, it is concluded that the interval is matching noise against noise and the interval is no longer called bad, and the processing for that interval is halted. Otherwise, the frame disturbance for the frames during the bad intervals is recomputed and, if it is smaller replaces the original frame disturbance. The result is the final frame disturbances $D''_n$ and $DA''_n$ that are used to calculate the perceived quality.

Aggregation of the Disturbance within Split Second Intervals

Next, the frame disturbance values and the asymmetrical frame disturbance values are aggregated over split second intervals of 20 frames (accounting for the overlap of frames: approx. 320 ms) using $L_6$ norms, a higher p value as in the aggregation over the speech file length. These intervals also overlap 50 percent and no window function is used.

Aggregation of the Disturbance Over the Duration of the Signal

The split second disturbance values and the asymmetrical split second disturbance values are aggregated over the active interval of the speech files (the corresponding frames) now using $L_2$ norms. The higher value of p for the aggregation within split second intervals as compared to the lower p value of the aggregation over the speech file is due to the fact that when parts of the split seconds are distorted that split second loses meaning, whereas if a first sentence in a speech file is distorted the quality of other sentences remains intact.

Computation of the PESQ Score

The final PESQ score is a linear combination of the average disturbance value and the average asymmetrical disturbance value.

The above described PESQ method (as prescribed in the ITU-T Recommendation P.862) has the disadvantage that it can not deal correctly with speech signals with large differences in frequency response variations. The frequency response variation compensation and local power scaling compensation are being calculated incorrectly, resulting in a wrong calculation of the speech quality of a system 10.

The present invention is based on the understanding that if a frequency compensation is calculated in the presence of noise a wrong estimate of the frequency response function will arise in frequency regions where there is little energy. If a local temporal scaling factor is calculated on a signal that has passed through system which shows large deviations in the frequency response the local scaling factor cannot be calculated correctly. Both effects have to be calculated correctly in order to be able to predict the subjectively perceived quality of speech signals.

In FIG. 3, a particular advantageous embodiment of the perceptual model part of the PESQ method is illustrated, corresponding to the illustration of FIG. 2. However, the calculation of the linear frequency compensation and the calculation of the local power scaling factor are different.

The linear frequency response compensation calculation and local power scaling factor calculation are put in an iterative loop. First, a rough estimate of the necessary frequency compensation is calculated. Next a partial linear frequency compensation is calculated which is lower than the linear frequency compensation one would use for correct evaluation of the linear distortion, e.g. 50% of the amplitude correction of the normal linear frequency compensation. This partial compensation can also be carried out by having limited frequency ranges over which a larger partial compensation is carried out than over other frequency ranges. One can e.g. only compensate frequency response variations as found with close microphone techniques that result in a low frequency boost below about 500 Hz.

By not compensating to the amount that one would normally carry out, one obtains a signal in time $PPX'_{WIRSS}(f)_n$ from which better estimations can be made regarding the local temporal scaling factor that is necessary for correctly predicting the final perceived quality. After this local scaling calculation, applied to the degraded signal $PPY_{WIRSS}(f)_n$ one obtains a time signal $PPY'_{WIRSS}(f)_n$ from which a better estimation can be made for the final necessary frequency compensation. The final frequency compensation (i.e. compensation for the remaining frequency deviations) applied to the partially compensated signal $PPX'_{WIRSS}(f)_n$ results in a final signal $PPX''_{WIRSS}(f)_n$. The resulting signals $PPY'_{WIRSS}(f)_n$ and $PPX''_{WIRSS}(f)_n$ are then further processed as described above (warping to loudness scale and subsequent steps).

For the person skilled in the art, it will be clear that further modifications can be made to the present embodiment. The amount of partial compensation can be adapted to the experimental context. Also it is possible to first calculate and apply a partial local power-scaling factor compensation, then calculate and apply the linear frequency response compensation and finally calculate and apply a final local power scaling factor. Also it is within the scope of the present invention to use more than three sub-steps in the iterative calculation steps.

REFERENCES INCORPORATED HEREIN BY REFERENCE

[1] BEERENDS (J. G.), STEMERDINK (J. A.): A Perceptual Speech-Quality Measure Based on a Psychoacoustic Sound Representation, *J. Audio Eng. Soc.*, Vol. 42, No. 3, pp. 115-123, March 1994.

[2] BEERENDS (J. G.): Modelling Cognitive Effects that Play a Role in the Perception of Speech Quality, *Speech Quality Assessment*, Workshop papers, Bochum, pp. 1-9, November 1994.

[3] BEERENDS (J. G.): Measuring the quality of speech and music codecs, an integrated psychoacoustic approach, 98*th AES Convention*, pre-print No. 3945, 1995.

[4] HOLLIER (M. P.), HAWKSFORD (M. O.), GUARD (D. R.): Error activity and error entropy as a measure of psychoacoustic significance in the perceptual domain, *IEE Proceedings—Vision, Image and Signal Processing*, 141 (3), 203-208, June 1994.

[5] RIX (A. W.), REYNOLDS (R.), HOLLIER (M. P.): Perceptual measurement of end-to-end speech quality over audio and packet-based networks, 106*th AES Convention*, pre-print No. 4873, May 1999.

[6] HOLLIER (M. P.), HAWKSFORD (M. O.), GUARD (D. R.), Characterisation of communications systems using a speech-like test stimulus, *Journal of the AES*, 41 (12), 1008-1021, December 1993.

[7] ZWICKER (Feldtkeller): Das Ohr als Nachrichtenempfänger, *S. Hirzel Verlag*, Stuttgart, 1967.

[8] ITU-T recommendation P.862, "Perceptual evaluation of speech quality (PESQ), an objective method for en-to-end speech qualtity assessment of narrow-band telephone networks and speech codecs", ITU-T 02.2001

[9] BEERENDS (J. G.); HEKSTRA (A. P.); RIX (A. W.); HOLLIER (M. P.), Perceptual Evaluation of Speech Quality (PESQ) The New ITU Standard for ENd-to-End Speech Quality Assessment Part II—Psychoacoustic Model, *J. Audio Eng. Soc.*, Vol. 50, no. 10, October 2002.

[10] European patent application EP02075973, Koninklijke KPN N.V.

The invention claimed is:

1. A method for measuring the transmission quality of an audio transmission system, an input signal (X) being entered into the system, resulting in an output signal (Y), in which both the input signal (X) and the output signal (Y) are processed, comprising the steps of:

preprocessing of the input signal (X) and output signal (Y) to obtain pitch power densities ($PPX_{WIRSS}(f)_n$, $PPY_{WIRSS}(f)_n$) for the respective signals;

compensating the pitch power densities for linear frequency response and time varying gain so as to obtain compensated pitch power densities ($PPX''_{WIRSS}(f)_n$, $PPY'_{WIRSS}(f)_n$), wherein the compensation of linear frequency response and time varying gain comprises an iterative loop having at least three compensation calculations, the calculations having a calculation of a first partial compensation of a first type, a calculation of a compensation of a second type, and a calculation of a second partial compensation of the first type, the first type of calculation and the second type of calculation comprising a different one of a calculation of compensation of linear frequency response and a calculation of a local power scaling factor; and computing, in response to compensated pitch power densities ($PPX''_{WIRSS}(f)_n$, $PPY'_{WIRSS}(f)_n$), a score (Q) indicative of transmission quality of the system.

2. Method according to claim 1, in which the iterative loop comprises a calculation of a first partial linear frequency compensation and application of the first partial linear frequency compensation to the pitch power density of the input signal ($PPX_{WIRSS}(f)_n$), followed by a calculation of a local power scaling factor and application of the local power scaling factor to the pitch power density of the output signal ($PPY_{WIRSS}(f)_n$), followed by a calculation of a second partial linear frequency compensation and application of the linear frequency compensation to the partially compensated pitch power density of the input signal ($PPX'_{WIRSS}(f)_n$).

3. Method according to claim 2, in which the first partial linear frequency compensation is a first estimate which is lower than a linear frequency compensation required for correct evaluation of the linear distortion.

4. Method according to claim 3, in which the first partial linear frequency compensation is a frequency dependent function.

5. Method according to claim 1, in which the iterative loop comprises a calculation of a first partial linear frequency compensation and application of the first partial linear frequency compensation to the pitch power density of the output signal ($PPY_{WIRSS}(f)_n$), followed by a calculation of a local power scaling factor and application of the local power scaling factor to the pitch power density of the input signal ($PPX_{WIRSS}(f)_n$), followed by a calculation of a second partial linear frequency compensation and application of the linear frequency compensation to the partially compensated pitch power density of the output signal ($PPY'_{WIRSS}(f)_n$).

6. Method according to claim 5, in which the first partial linear frequency compensation is a first estimate which is lower than a linear frequency compensation required for correct evaluation of the linear distortion.

7. Method according to claim 6, in which the first partial linear frequency compensation is a frequency dependent function.

8. A software program product stored on computer readable media and comprising computer executable instructions, which when executed on a processing system, causes the processing system to perform the method recited in claim 1.

9. A system for measuring the transmission quality of an audio transmission system, an input signal (X) being entered into the system, resulting in an output signal (Y), comprising:

means for preprocessing of the input signal (X) and output signal (Y) to obtain pitch power densities ($PPX_{WIRSS}(f)_n$, $PPY_{WIRSS}(f)_n$) for the respective signals;

means, responsive to the pitch power densities, for compensating linear frequency response and time varying gain so as to obtain compensated pitch power densities ($PPX''_{WIRSS}(f)_n$, $PPY'_{WIRSS}(f)_n$), wherein the compensation comprises an iterative loop having at least three compensation calculations, the calculations having a first partial compensation of a first type, a calculation of a compensation of a second type, and a calculation of a second partial compensation of the first type, the first type of calculation and the second type of calculation comprising a different one of a calculation of compensation of linear frequency response and a calculation of a local power scaling factor; and means, responsive to from the compensated pitch power densities densities ($PPX''_{WIRSS}(f)_n$, $PPY'_{WIRSS}(f)_n$), for computing a score (Q) indicative of transmission quality of the system.

10. System according to claim 9, in which the iterative loop comprises a calculation of a first partial linear frequency compensation and application of the first partial linear frequency compensation to the pitch power density of the input signal ($PPX_{WIRSS}(f)_n$), followed by a calculation of a local power scaling factor and application of the local power scaling factor to the pitch power density of the output signal ($PPY_{WIRSS}(f)_n$), followed by a calculation of a second partial linear frequency compensation and application of the second partial linear frequency compensation to the partially compensated pitch power density of the input signal ($PPX'_{WIRSS}(f)_n$).

11. System according to claim 10, in which the first partial linear frequency compensation is a first estimate which is lower than a linear frequency compensation required for correct evaluation of the linear distortion.

12. System according to claim 11, in which the first partial linear frequency compensation is a frequency dependent function.

13. System according to claim 9, in which the first partial linear frequency compensation is a first estimate which is lower than a linear frequency compensation required for correct evaluation of the linear distortion.

14. System according to claim 13, in which the iterative loop comprises a calculation of a first partial linear frequency compensation and application of the first partial linear frequency compensation to the pitch power density of the output signal ($PPY_{WIRSS}(f)_n$), followed by a calculation of a local power scaling factor and application of the local power scaling factor to the pitch power density of the input signal ($PPX_{WIRSS}(f)_n$), followed by a calculation of a second partial linear frequency compensation and application of the second partial linear frequency compensation to the partially compensated pitch power density of the output signal ($PPY'_{WIRSS}(f)_n$).

15. System according to claim 13, in which the first partial linear frequency compensation is a frequency dependent function.

* * * * *